US007134565B1

(12) United States Patent
Wan et al.

(10) Patent No.: US 7,134,565 B1
(45) Date of Patent: Nov. 14, 2006

(54) CLOSURE HAVING BAND WITH INTERNAL THREAD FORMED BY IMPRESSION

(75) Inventors: Min Miles Wan, Plainfield, IL (US); Emanuel Shenkar, Worth, IL (US); James L. Martin, Lancaster, OH (US); Larry Hottle, Granville, OH (US); Galen German, Lancaster, OH (US)

(73) Assignee: Crown Cork & Seal Technologies, Alsip, IL (US)

( * ) Notice: Subject to any disclaimer, the term of this patent is extended or adjusted under 35 U.S.C. 154(b) by 207 days.

(21) Appl. No.: 10/079,769

(22) Filed: Feb. 21, 2002

Related U.S. Application Data

(60) Provisional application No. 60/270,757, filed on Feb. 22, 2001.

(51) Int. Cl.
*B65D 45/30* (2006.01)

(52) U.S. Cl. ..... 215/276; 215/317

(58) Field of Classification Search ..... 215/276, 215/329, 525, 367, 318, 273, 278, 291, 292, 215/317, 336–338, 358, DIG. 1, 327, 337, 215/298; 220/289
See application file for complete search history.

(56) References Cited

U.S. PATENT DOCUMENTS

| | | | | |
|---|---|---|---|---|
| 2,597,830 A | | 5/1952 | Webb | 226/34 |
| 4,493,427 A | * | 1/1985 | Wolkonsky | 215/230 |
| 4,694,970 A | * | 9/1987 | Hayes | 215/252 |
| 4,709,825 A | * | 12/1987 | Mumford | 215/318 |
| 4,717,034 A | * | 1/1988 | Mumford | 215/318 |
| 4,721,219 A | * | 1/1988 | Dullabaun et al. | 215/274 |
| 4,793,499 A | * | 12/1988 | Dubach et al. | 215/230 |
| 5,165,978 A | | 11/1992 | Lecinski | 428/66 |
| 5,190,177 A | | 3/1993 | Collins | 215/252 |
| 5,346,082 A | | 9/1994 | Ochs et al. | 215/252 |
| 5,443,853 A | * | 8/1995 | Hayes | 426/107 |
| 5,685,443 A | | 11/1997 | Taber et al. | 215/252 |
| 6,056,136 A | * | 5/2000 | Taber et al. | 215/252 |
| 6,142,325 A | * | 11/2000 | Chomik | 215/343 |

FOREIGN PATENT DOCUMENTS

| | | |
|---|---|---|
| DE | 2 233 305 | 1/1974 |
| GB | 1 004 473 | 9/1965 |
| WO | WO 96/27532 | 9/1996 |
| WO | WO 98/52833 | 11/1998 |
| WO | WO 01/87726 A1 | 11/2001 |

* cited by examiner

*Primary Examiner*—Lien M. Ngo
(74) *Attorney, Agent, or Firm*—Woodcock Washburn LLP

(57) ABSTRACT

A closure for mating with a container has a threaded finish. The closure comprises a flange and a skirt downwardly depending therefrom. The skirt includes a deformable element formed of a different material than that of the flange and skirt and disposed on an interior surface. The deformable element inner diameter is smaller than the outer diameter of the container, and accordingly deforms upon mating the closure with the container. The container threads impress threads into the deformable element to form threads on the closure. The deformable element is formed of a suitable material. The closure of the present invention provides for the use of high-speed press-on capping equipment.

39 Claims, 14 Drawing Sheets

CLOSURE HAVING BAND WITH INTERNAL THREAD FORMED BY IMPRESSION

This application claims the benefit of U.S. Provisional Application No. 60/270,757 filed Feb. 22, 2001, which is incorporated by reference herein.

BACKGROUND OF THE INVENTION

The present invention relates to container closures, and more particularly to closures having threads formed thereon and related methods.

Conventional injection molded, plastic closures often include a circular top member, a cylindrical skirt that depends downwardly from the top member, threads formed on the interior of the skirt, and a tamper evident band formed on a lower rim of the skirt. Typically, such closures are molded in a one-step process such that the top member, skirt, and threads are integrally formed. Closures having threads integrally molded as part of the skirt typically require a rotary capper operation to twist the threaded closure onto matching threads on the container finish. A conventional rotary capper process is relatively slow and requires expensive machinery compared with commercial, high-speed, conventional press-on or in-line capper technology.

Conventional composite closures typically include a metal panel for covering and sealing to a container rim and a threaded plastic band for coupling to mating container threads. U.S. Pat. No. 5,685,443 discloses embodiments of such a band that may be pressed-on and twisted-off Another type of conventional closure is formed of an integral metal top member and metal skirt. A particular type of metal skirt is formed with a smooth, cylindrical sidewall. A liquid or flowable material, such as plastisol, is subsequently applied to the skirt inner wall, usually by spraying while the closure is spinning. The plastisol, or like material, is formed on the skirt sidewall by a process that includes baking, curing, or a similar treatment step. U.S. Pat. No. 5,190,177 discloses a press-on, twist-off metal closure having a conventional lining into which threads are formed by the container thread, and requires a baking or curing step.

Further, the baking or curing process makes it difficult or infeasible to provide such a metal closure with an integrally formed, frangible tamper evident band of the type that depends from the bottom of the skirt and detaches upon removal of the closure from the container. Although the metal top member may include a button-type tamper evident feature, for hot-fill applications, it is often preferable to employ a frangible, tamper evident band. For example, the U.S. Pat. No. 5,190,177 patent discloses that the tamper evident band is formed by a separate security ring that is fitted into an annular shoulder formed on the peripheral skirt.

Thus, there is a need for improved closures, and techniques for forming closures.

SUMMARY OF THE INVENTION

The present invention relates to container closures, methods and molding systems for molding closures, and methods for combining containers and closures to form packages, including but not limited to hermetically sealed packages. According to an aspect of the present invention, a closure is provided that mates with a container having a finish that includes threads formed thereon. The closure comprises a flange; a skirt depending downwardly from a periphery of the flange and a deformable element disposed on an interior surface of the skirt that is deformable by the container threads to impress a closure thread into the element. Thus, the closure may be applied with straight-line capping equipment. The closure may include at least one passage extending through the flange or skirt.

The closure may be a composite closure such that the flange is disposed over an insert disk. The insert disk may form an annular channel in which a sealant is disposed to enhance the seal between the insert disk and the container rim. Further, the present invention enables the insert disk to be floatable with respect to the flange and/or skirt. The present invention encompasses any channel configuration, or alternatively, the flange may be a continuous disk. The deformable element is spaced apart from the insert disk, and/or from the flange.

According to another aspect of the present invention, a method for molding a closure comprises injecting a first material into a first mold cavity so as to form a closure flange and skirt, and subsequently injecting a second material into a second cavity that is coupled to the first cavity. According to yet another aspect of the present invention, at least one passage may be formed through the wall of the closure, such as from the exterior surface of the flange or skirt of the closure to an interior surface such that the second material may flow through the passage during injection of the second material.

A molding system for making closures provided by the present invention may include a first closure cavity surface and a first closure core surface defining a first closure cavity therebetween. The first closure cavity preferably includes a flange portion and a skirt portion for forming a closure having a corresponding flange and a skirt, and a second closure core and an interior wall of the skirt defining a second closure cavity therebetween for forming a deformable element disposed on the interior surface of the skirt. The first and second cavities may be formed within the same apparatus or in separate molding apparatus, as will be clear to persons generally familiar with conventional sequential injection molding.

According to another aspect of the present invention, a pin may extend into a portion of the first closure cavity from the first closure cavity surface to the first closure core for defining a passage within the first material through the flange and the skirt. Material may be injected through the passage into the second closure cavity.

According to another aspect of the present invention, methods for closing a package comprising a closure of the present invention and a container having a finish with a thread thereon have been provided. One method includes providing a container having a finish with threads disposed thereon, providing a closure having a deformable element disposed on an interior surface of the closure skirt, and urging the closure onto the container finish such that the element is deformed by the container thread to impress threads therein.

PREFERRED EMBODIMENTS OF THE PRESENT INVENTION

Figure 1:
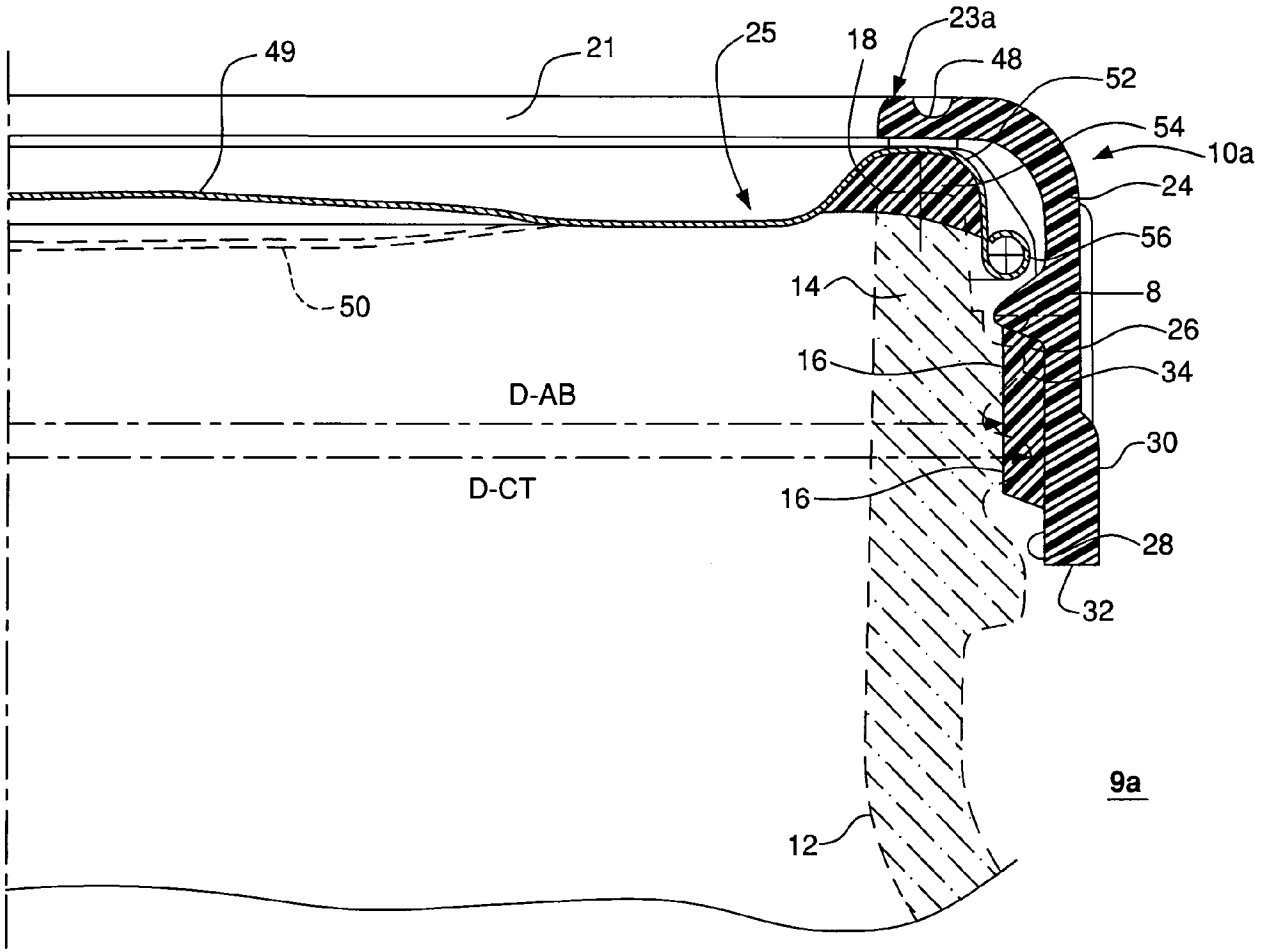
FIG. 1 is a sectional view of a portion of a container and a closure according to a first embodiment of an aspect of the present invention illustrating the deformable element in an undeformed state.

According to aspects of the present invention, each of FIGS. 1 through 4 illustrates an embodiment of a container package 9*a* through 9*d*, respectively, each of which includes a container and a closure. Preferably the containers are formed of a glass or a plastic that is suitable for vacuum-creating filling processes as will be understood by persons familiar with commercial filling technology. The present invention is not limited thereto, but rather encompasses any container and/or closures formed of any material and may be employed with any configuration of containers and closures, regardless of the manner of their use.

The container packages illustrated in FIGS. 1 through 4 each include a closure, as described more fully below, and a container 12, which includes a finish 14 having threads 16 formed on an exterior thereof. Finish 14 forms a rim 18.

As shown in FIG. 1 and according to a first embodiment of an aspect of the present invention, a closure 10*a* includes a flange 23*a*, a skirt 24, an insert disk 25, and a deformable element 26. Skirt member 24 is substantially cylindrical and includes an interior surface 28, an opposing exterior surface 30, and a rim 32 formed at a bottom surface defined by interior surface 28 and exterior surface 30. A substantially annular retaining member 8 protrudes inwardly from interior surface 28. Flange 23*a* extends radially inwardly from an upper portion of skirt 24 and defines an opening 21 therein. Closure 10*a* also includes a gate 48, as described more fully below.

Flange 23*a* and skirt 24 preferably are formed by injection molding a plastic material to form an integral, single piece. Any plastic may be employed for forming flange 23*a* and skirt 24, such as for example a polyolefin, including, but not limited to, high density polyethylene and polypropylene. U.S. Pat. No. 5,346,082, entitled "Composite Closure With Sealing Force Indicating Means And Ratchet Operated Tamper Indicating Band," which is assigned to the assignee of the present invention and incorporated herein by reference in its entirety, discloses a composite closure having a skirt, flange, and insert disk Insert disk 25 is disposed between the underside off flange 23*a* and a retaining member 8 that protrudes inwardly from skirt 24. Insert disk 25 may include an optional, central button-type tamper evident indicator 49 disposed at a center of disk 25, an annular channel 52 that receives the container rim 18, a sealant, such as plastisol 54 or like material or component, disposed in annular channel 52, and a bead or curl 56 disposed at an outer edge of disk 25. Tamper indicating button 49 is shown in its up position in FIG. 1. Plastisol 54, as illustrated in the Figures, preferably forms a seal against a top surface of container rim 18, and seals against both an upper inside surface and an upper outside surface of container finish 12 proximate rim 18. Such a three-way seal may accommodate dimensional irregularities or tolerance ranges of the respective parts, as well as maintaining a seal during thermal expansion and contraction during hot filling or retort operations. In most circumstances, including those in which disk 25 is formed of metal and flange 23*a* and skirt 24 are formed of a plastic, the parts have different coefficients of thermal expansion for which sealant 54 is beneficial.

After the capping and filling processes, the panel, which may (optionally) include button 49, deflects to a down position upon cooling of the contents (not shown) and creation of vacuum conditions within container 12. The down or vacuum button position is diagrammatically shown in dashed lines in FIG. 1.

Preferably, retaining member 8 is spaced apart from the underside of flange 23*a* such that insert disk 25—that is, curl 56—is floatable therebetween (while the closure 10*a* is, for example, un-connected from the container 12). Insert disk 25 may be made by conventional means of metal, although other materials, including thermoplastic, are encompassed by the present invention. The present invention is not limited to the particular configuration of insert disk 25, but rather encompasses any insert disk configuration, as well as closures lacking an insert disk, as explained more fully below. Other methods of making insert disk 25 may also be employed Retaining member 8 provides an upper boundary during the injection of the material forming deformable element 26, as well as a providing a stop against which deformable element 26 may urge during capping. Thus, the material forming deformable element 26 may be kept spaced apart from rim 18 of the container during and subsequent to the capping process. For embodiments including a composite closure, such a spacing may be advantageous during the capping or opening process, or the like.

Figure 6:
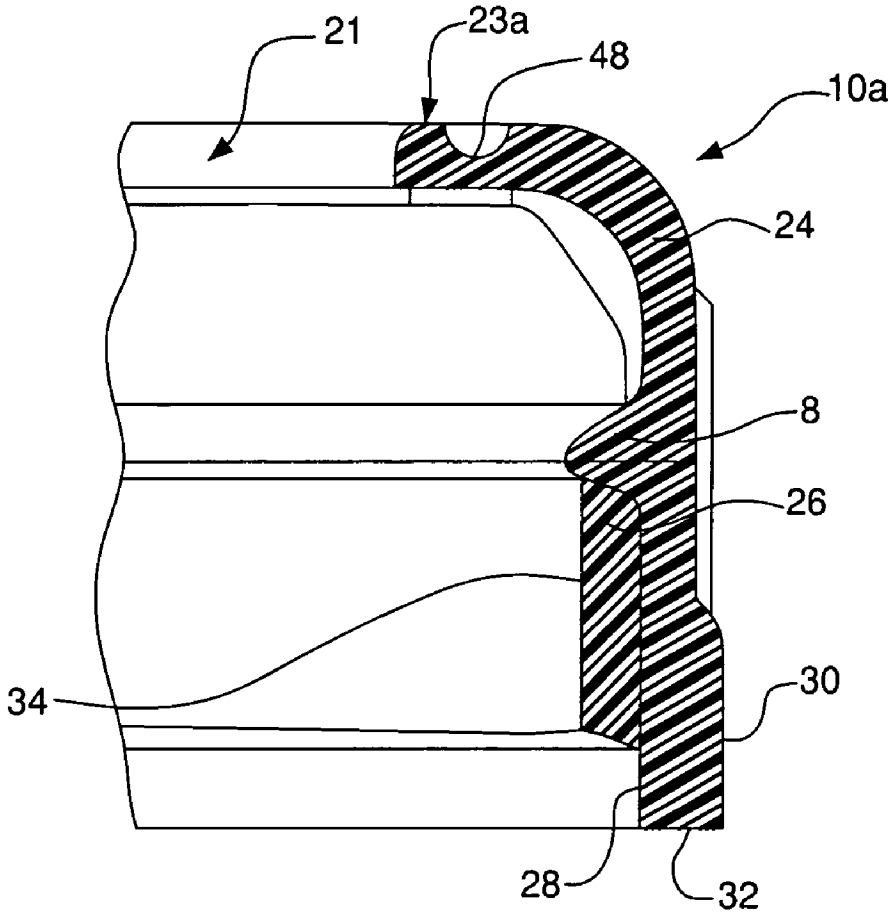
FIG. 6 is a sectional view of a portion of the closure shown in FIG. 1.

A first embodiment of deformable element 26 is shown in FIG. 1 (as well as in FIGS. 2 through 4) in an undeformed, as-molded state. FIG. 6 also illustrates deformable element 26 in an undeformed state prior to coupling with container 12. In its undeformed state, inner surface 34 has a inner diameter D-AB that is less than an outer diameter D-CT of the container threads 16. Deformable element 26 is formed on interior surface 28 of skirt 24 such that inside surface 34 of deformable element 26 (in its undeformed state) preferably is cylindrical (that is, flat in longitudinal cross section as shown in the Figures). In this regard, container 12 is shown in FIG. 1 (as well as in FIGS. 2 through 4) in dashed lines to enable deformable element 26 to be shown in its undeformed state for clarity. The present invention also encompasses deformable elements having inner surfaces that are irregular, conical, and of other configurations.

Thus, element 26 is formed of a material that is deformable and has a desirable compression set compared with that of the material that forms skirt 24. Further, element 26 preferably is formed of a material that is substantially incompressible, although the present invention encompasses materials of a wide range of compressibilities that are suitable for the required deformation. The term "incompressible" as employed herein refers to a material that maintains an approximately constant volume while a stress or force is applied to at least a portion thereof, and encompasses materials that temporarily compress and rebound.

Element 26 may be formed of any suitable material (encompassing incompressible materials and/or compressible materials), and it has been found to be helpful to describe some suitable materials by employing the parameters of hardness and compression set. The following is a nonexclusive list of suitable materials:

ADVANCED ELASTOMER SYSTEM ("AES") TREFSIN Number 3271-65W308, Hardness: 65 (Shore "A", nominal), Compression Set: 13% 22 hrs. @23° C. & 49% 22 hrs. @100° C.;

TEKNOR APEX Number MP 2870M, Hardness: 70 (Shore "A"), Compression Set: 25% @ 23° C.;

AES VYRAM Number 9201-55, Hardness: 55 (Shore "A"), Compression Set: 25% 168 hrs. @ 23° C. & 40% 168 hrs. @ 100° C.; and/or AES VYRAM Number 9201-65, Hardness: 65 (Shore "A"), Compression Set: 28% 168 hrs. @23° C. & 43% 168 hrs. @ 100° C.

The above values for hardness are according to ASTM D2240, and for compression set are according to ASTM D 395, Method B.

International Patent Application PCT/GB98/01467, which is assigned to the assignee of the present invention, discloses a press-on/twist-off closure having a single pre formed gasket into which both the threads and a seal between the closure and the container rim are formed. Such a configuration is generally commercially disadvantageous for use with composite closures, as well as with other closures employed with a hot-filling or retort process (or other process that subjects the container to internal vacuum pressures), or with closures for which it is desired to form a seal between the closure and the container rim by means other than the single, deformable gasket. The international application also includes a list of materials that may be suitable for use as deformable element 26 of the present invention in some circumstances. Table 1 from the international application is reproduced herein.

Figure 2:
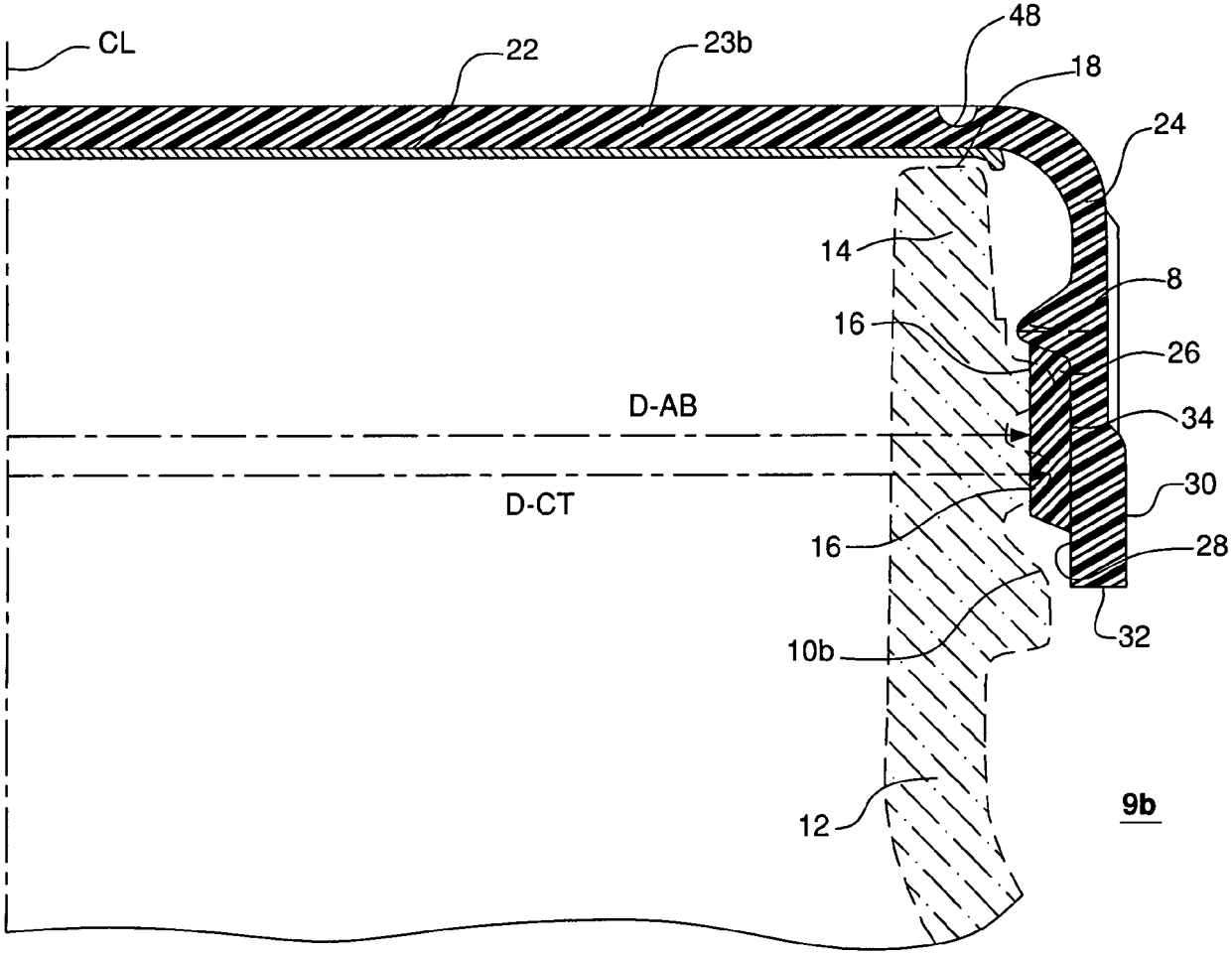
FIG. 2 is a sectional view of a portion of a container and a closure according to a second embodiment of an aspect of the present invention illustrating the deformable element in an undeformed state.

According to another embodiment of the present invention as shown in FIG. 2, a closure 10*b* includes substantially flat, circular top portion 23*b*, a cylindrical skirt 24 depending downwardly from an outer periphery of top portion 23*b*, and a deformable element 26. A liner 22 may be disposed on the underside of flange 23*b*, as shown in FIG. 2. Liner 22 may be conventional, and/or may include an oxygen scavenging compound as will be understood by persons familiar with such technology. Flange 23*b* and skirt 24 preferably are integrally formed by injection molding, using thermoplastic materials—for example those materials comprising a polyolefin. Closure 10*b*, as shown in FIG. 2, does not have an insert disk, but rather flange 23*b* is continuous such that it covers the container opening, thereby forming a one-piece closure 10*b*.

Figure 3:
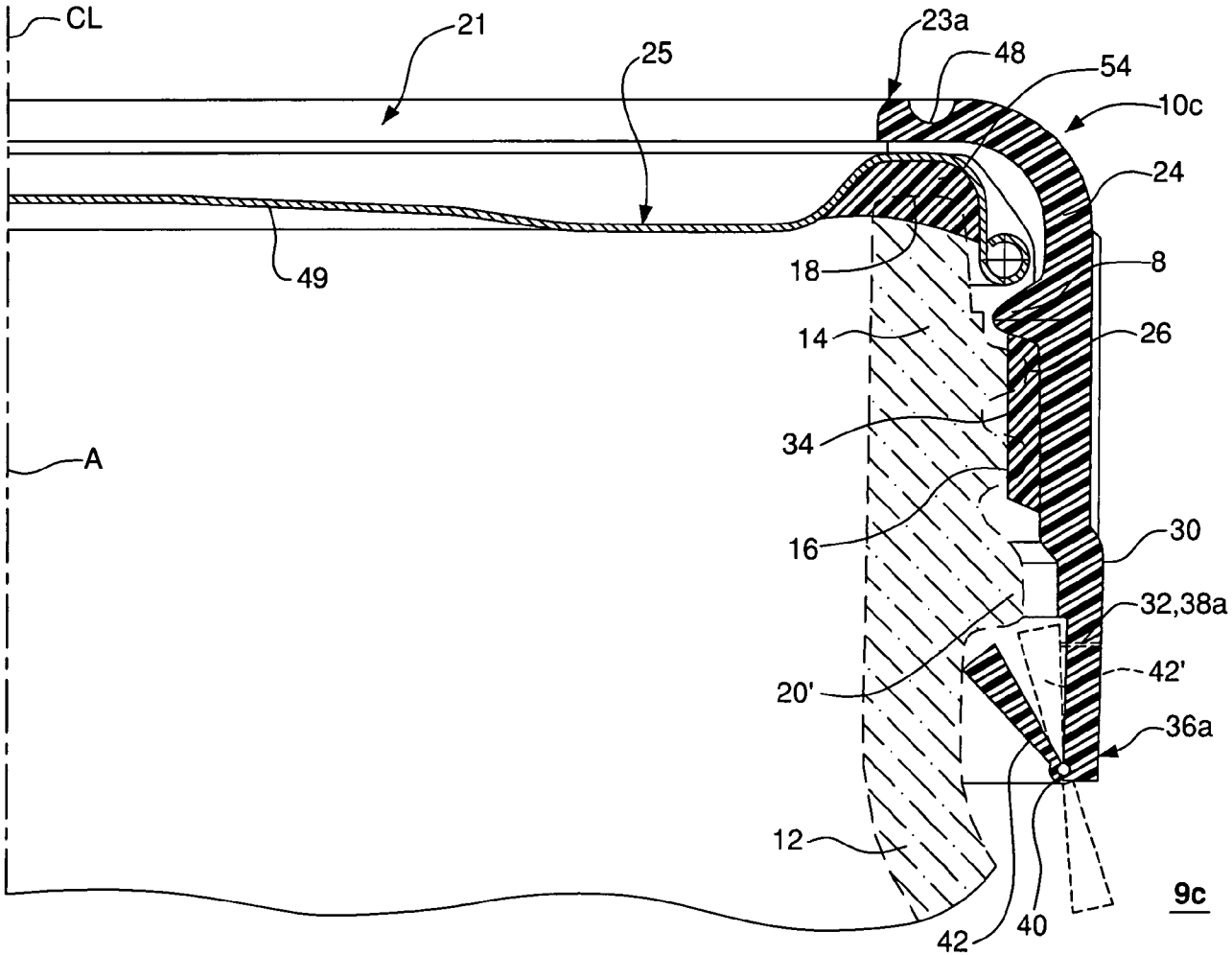
FIG. 3 illustrates the first embodiment shown in FIG. 1 including a tamper evident band illustrating the deformable element in an undeformed state.
Figure 4:
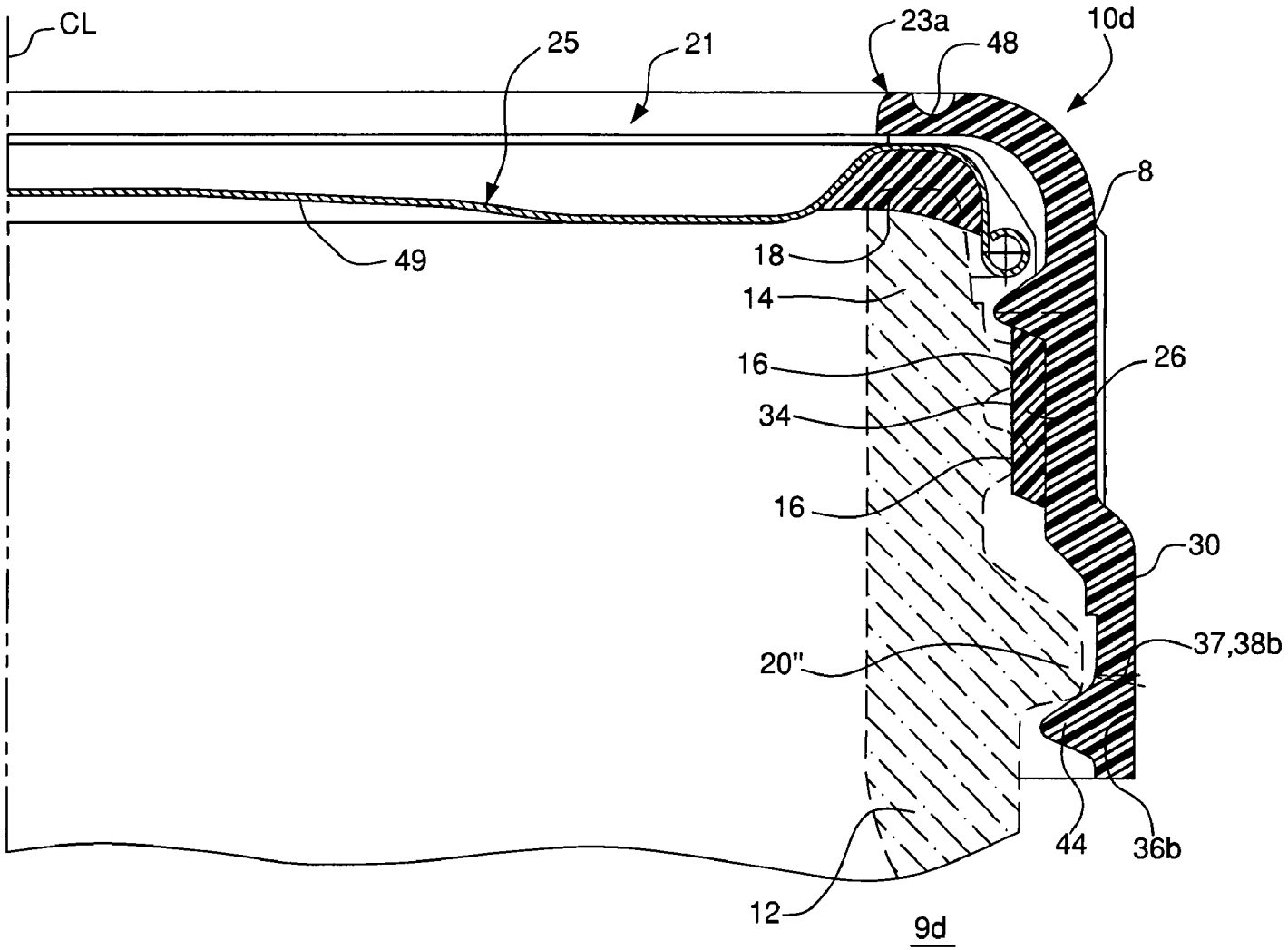
FIG. 4 illustrates the first embodiment shown in FIG. 1 including another tamper evident band.

Closures 10*a* and 10*b* are shown in FIGS. 1 and 2 without tamper evident bands, although the present invention encompasses closures 10*a* and 10*b* having tamper evident bands. In this regard, as best shown in FIGS. 3 and 4, according to another aspect of the present invention, closures 10*c* and 10*d* illustrate closure 10*a* with the addition of a tamper evident band. Closures 10*c* and 10*d* are, thus, structurally similar to closure 10*a* except for tamper evident bands 36*a* and 36*b*. For convenience, only closure 10*a*, rather than both closures 10*a* and 10*b*, is shown herein having a tamper evident band. As will the clear to a person generally familiar with the configuration and design of conventional closure configuration and technology in light of the present disclosure, the present invention encompasses all types of closures, including closure 10*b*, having any type of tamper evident band (such as, for example, vented or unvented, integrally formed with skirt 24 or mechanically joined, including conventional draining or wash-out features to enable liquid in the thread area to drain, etc.).

As shown in FIG. 3, closure 10*c* includes a tamper evident band 36*a* that is frangibly connected to lower rim 32 of skirt 24 at frangible connection 38*a*. Tamper evident band 36*a* includes a hinge portion 40 and a moveable band 42 coupled to hinge portion 40 opposite skirt rim 32. Positions of band 42 are shown in dashed lines in FIG. 3 to indicate its capability to pivot about hinge 40. After the assembly of closure 10*c* onto container finish 14, band 42 is disposed on an underside of a tamper evident bead 20' that protrudes from the outer sidewall of container finish 14.

As shown in FIG. 4, closure 10*d* includes a tamper evident band 36*b* that is frangibly connected to the lower end of skirt rim 32 at a frangible connection 38*b*. Tamper evident band 36*b* includes a flange 44 that protrudes inwardly from an inner sidewall of tamper evident band 36*b* below frangible connection 38*b*. After the assembly of closure 10*d* onto container finish 14, flange 44 is disposed on an underside of a tamper evident bead 20" that protrudes from the outer sidewall of container finish 14.

Preferably, closures 10*c* and 10*d* are configured for sequential opening such that, during the opening process, first the friction force of the threads is overcome to initiate twisting, then tamper evident band 36*a* or 36*b* is ruptured, followed by opening of disk 25 by retaining member 8, which urges upwardly against disk curl 56.

Figure 5A:
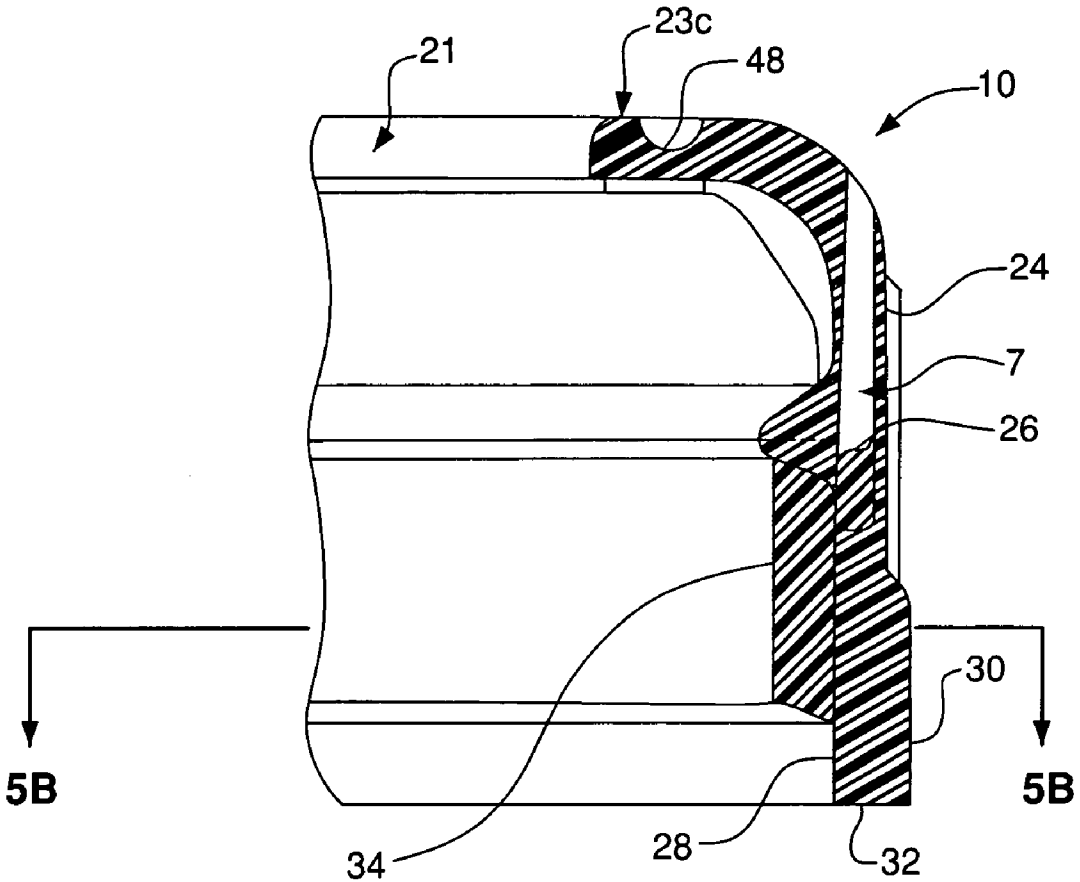
FIG. 5A is a sectional view of a portion of a closure illustrating another aspect of the present invention.
Figure 5B:
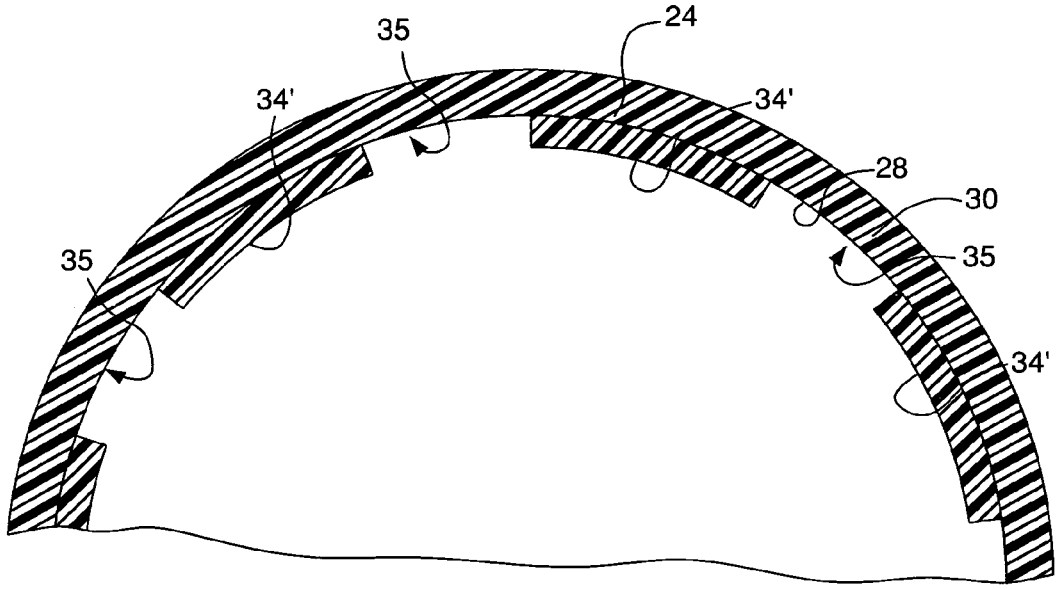
FIG. 5B is a sectional view of a portion of the closure taken through lines 5B—5B in FIG. 5A illustrating an exemplary configuration of the deformable element.

According to another embodiment of the present invention, as shown in FIG. 5, a closure 10*e* includes a flange 23*c*, a skirt 24, a passage 7 extending through a portion of flange 23 and skirt 24, and element 26. A portion of passage 7 is shown with cross hatching to illustrate that passage 7 serves as a runner for injecting material during the formation of element 26. The material within passage 7 is referred to herein as a branch. Forming the runner internal to the closure (that is, as illustrated by passage 7) diminishes costs and complexities involved with post-molding separation of closure and a runner, and the disposal/recycling of the runner. A corresponding mold and molding process associated with manufacturing a closure such as 10*e* will be discussed in more detail below.

Figure 7:
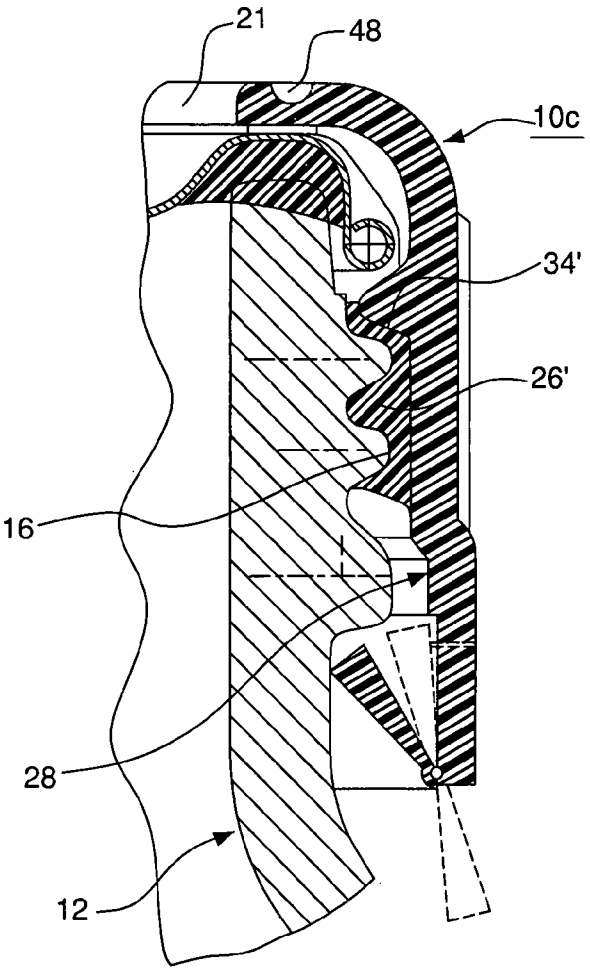
FIG. 7 is a sectional view of the embodiment of the container and closure shown in FIG. 3 illustrating the deformable element in a deformed state with closure threads formed therein.

Each of the FIGS. 1 through 6 shows deformable element 26 in its undeformed, as-molded state to show the configuration of element 26 in its as-molded state and to illustrate the dimensional relationship between the as-molded state of element 26 and container threads 16, and the like. Upon the molding of any of the closures 10*a*10*e*, the closure may be installed onto container 12. In this regard, FIG. 7 shows the closure 10*c* coupled to container 12 to illustrate the deformation and forming of deformable element 26 and forming of closure threads 19 therein.

Element 26 may be circumferentially continuous or discontinuous. In this regard, a circumferentially continuous element would inhibit insect access to the portion of the closure 10*a*–10*e* above the threads. Alternatively, element 26 may be formed of discontinuous segments of deformable material, which are identified by reference numeral 34' in FIG. 5B. Discontinuous elements 34' form spaces 35 therebetween. The configuration illustrated in FIG. 5B may be beneficial in that spaces 35 may provide space into which a portion of elements 34' may be pushed during application. The present invention encompasses employing a continuous or discontinuous element 34,34', depending on the particular parameters of the application, as will be understood by persons familiar with such parameters. Further, any configuration of discontinuous elements 34' is contemplated.

In this regard, embodiment 10*c* of the closure is employed to describe a method of forming threads via impression or deformation according to another aspect of the present invention. Closure 10*c*, as shown in FIG. 3 but omitting container 12, may be molded according to the methods and apparatus described herein or by any other processes. Upon molding, deformable element 26 is undeformed—for example as shown in FIG. 6.

Closure 10*c* may be urged onto container 12, which typically would include a food or beverage product disposed therein, directly downward along a longitudinal axis without twisting of closure 10*c* (that is, without twisting closure 10*c* about longitudinal axis A). Depending on the particular characteristics of the material of deformable element 26, closure 10*c* may be urged downwardly such that the centerline CL is parallel or co-linear with a longitudinal axis (not explicitly identified in the figures) of the container finish 14 or such that centerline CL is angled thereto—that is, closure 10*c* may be angled relative to container 12 during application.

While deformable element 26 is urged onto the container finish 14, the element 26 deforms sufficiently to extend into at least a portion of the area between the container threads 16. Referring to FIGS. 1 and 7, as closure 10*c* (as molded) is urged downwardly toward container 12, the uppermost portion of container thread 16 contacts lowermost portion of deformable element 26. Because the container thread outer diameter D-CT is greater than the deformable element inner diameter D-AB, the material of deformable element 26 must deform as closure 10*c* is urged downwardly relative to container 12.

Thus, the material of deformable element 26 preferably is deformable so as to deform over threads 16 in response to urging of closure 10*c* onto container finish 14. Other attributes of the material of element 26 include a relatively low recovery rate to facilitate such deformation, a intermediate or relatively high compression set. The present invention, however, is not limited to materials having such attributes. Rather, the present invention encompasses employing any suitable material, as will be understood by persons familiar with deformable materials in light of the present disclosure, and reference should be made to the claims to ascertain the scope of materials.

The material of deformable element 26 thus deforms as the upper portion of thread 16 is further urged relative to the deformable element material. At least in part because the preferred deformable element material undergoes no or a small amount of volume change (at the end or long after the closure is coupled with the closure), the material of the deformable element deforms to substantially fill the spaces between the container threads 16, thereby forming closure threads 34'. Further, tamper evident band 36*a*, with band 42 in its upward or fishhook position 42', clears container threads 16. Container rim 18 urges into plastisol in groove 54, where applicable and as described above.

Thus, as illustrated in FIG. 7, the material of the deformable element upon deformation forms deformable element 26 having a surface 34' that has threads impressed therein so as to mate to container threads 16. In this regard, a press-on or straight-line capper is used to urge closure 10*c* onto container 12 and the threads are formed as described herein. Although it is understood that employing a press-on or straight-line capper is preferred over employing a rotary capper for speed and economy, the present invention encompasses employing a rotary capper to twist closure 10*c* onto the container and thereby form surface threads 34'. Further, the urging step encompasses pressing, rotating or both pressing and rotating the closure onto the container. During the urging step, the deformable element, disposed on the interior surface of the closure, deforms and container threads impress closure threads into the deformable element to form the closed package. To gain access to the container contents, a consumer may twist the closure off the container.

Figure 8:
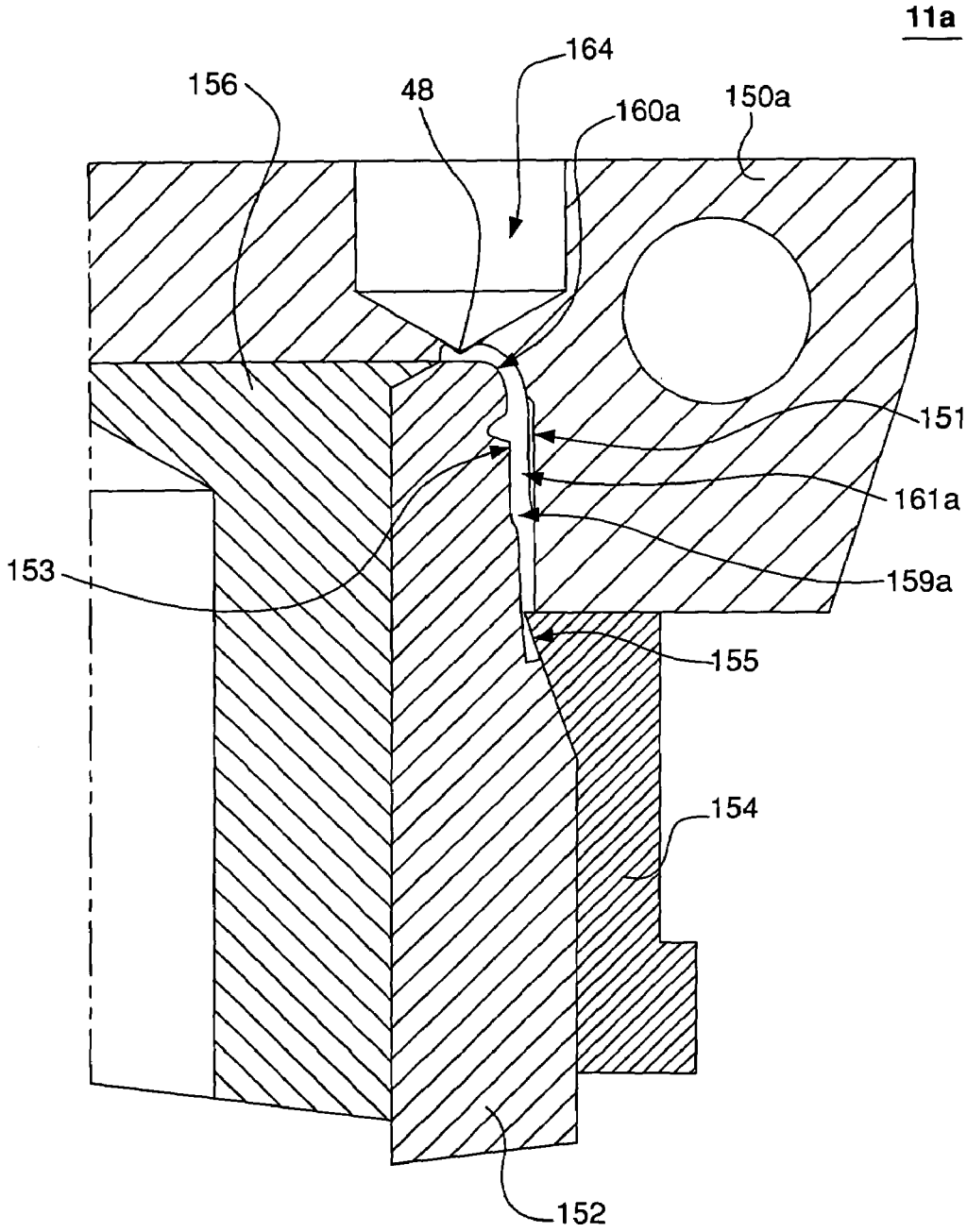
FIG. 8 is a sectional view of a first portion of a molding system according to an aspect of the present invention.
Figure 9:
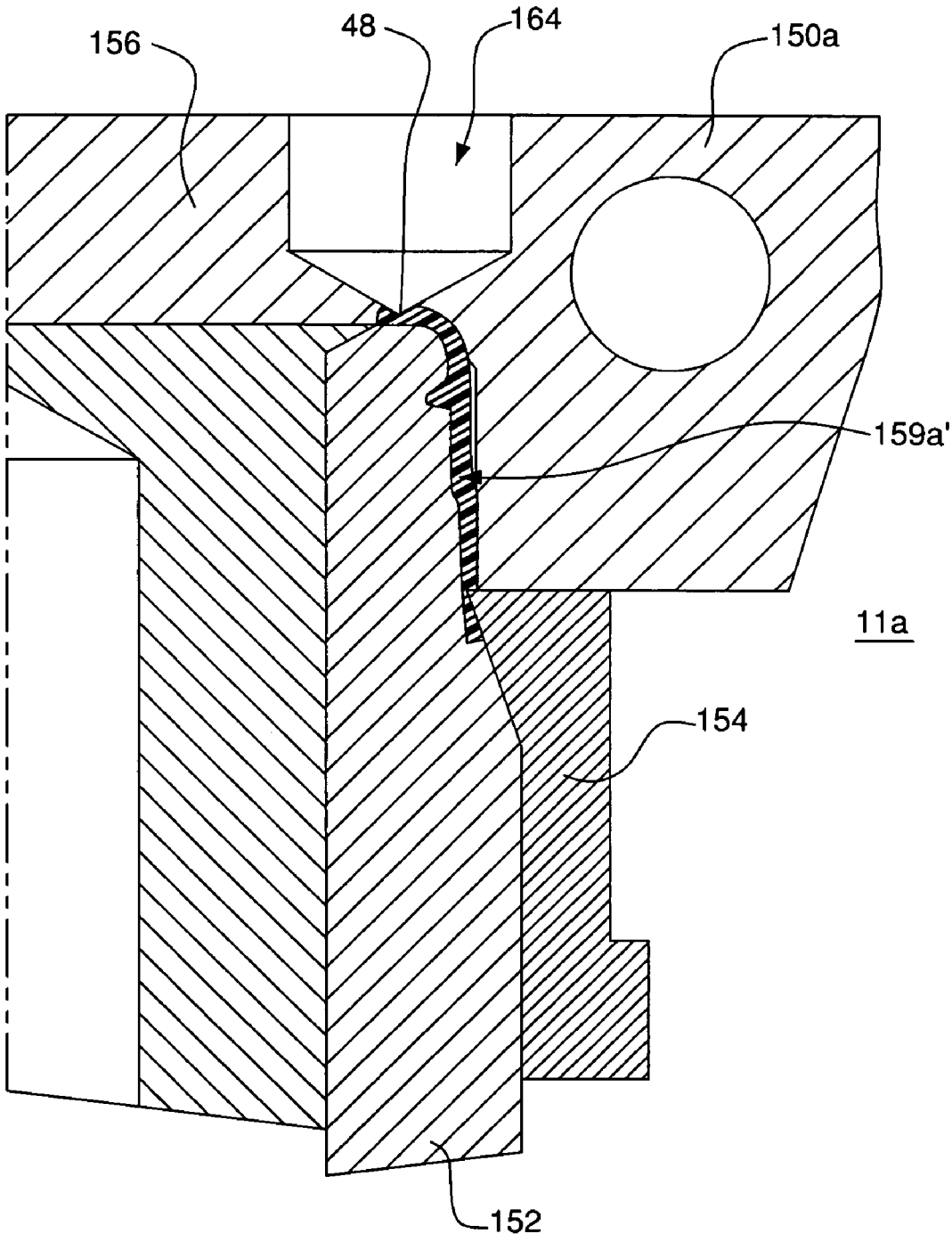
FIG. 9 is a sectional view of the portion the molding system of FIG. 8 illustrating a portion of a closure formed therein.

According to another aspect of the present invention, molding systems and methods for forming closures of the present invention will be described with respect to FIGS. 8 through 13 and by again employing the configuration of closure 10*c* for illustration. As shown in FIGS. 8 and 9, a system 11*a* for molding at least a portion of the closures according to the present invention includes a molding cavity block 150*a*, a molding core 152, a stripper 154, and an ejector 156. Cavity block 150*a* defines a sprue 164 therethrough. Sprue 164 includes a tip that forms gate 48. FIGS. 1 through 6 also employ reference numeral 48 to indicate the gate on the closure.

Cavity block 150*a* defines a cavity surface 151, core 152 defines a mold core surface 153, and stripper 154 defines a surface 155 such that surfaces 151, 153, and 155 define a cavity 159*a*. Cavity 159*a*, according to an aspect of the present invention, forms the shape of the closure 10*c* except for deformable element 26. In this regard, cavity 159*a* includes a cavity flange portion 160*a* and a cavity skirt portion 161*a* that generally and respectively correspond to closure flange 23*a* (or 23*b*) and skirt 24. Core surface 153 in the cavity skirt portion 161*a* corresponds to skirt interior surface 28.

To fill cavity 159*a*, a material, such as a conventional thermoplastic material, is injected by conventional means through sprue 164 and gate 48 into cavity 159*a*, as will be understood by persons familiar with injection molding processes. FIG. 9 illustrates cavity 159*a* in its filled state to produce a portion of closure 10*c* (that is, the portion of closure 10*c* other than deformable element 26), which will be referred to by reference numeral 159*a'*.

Figure 10:
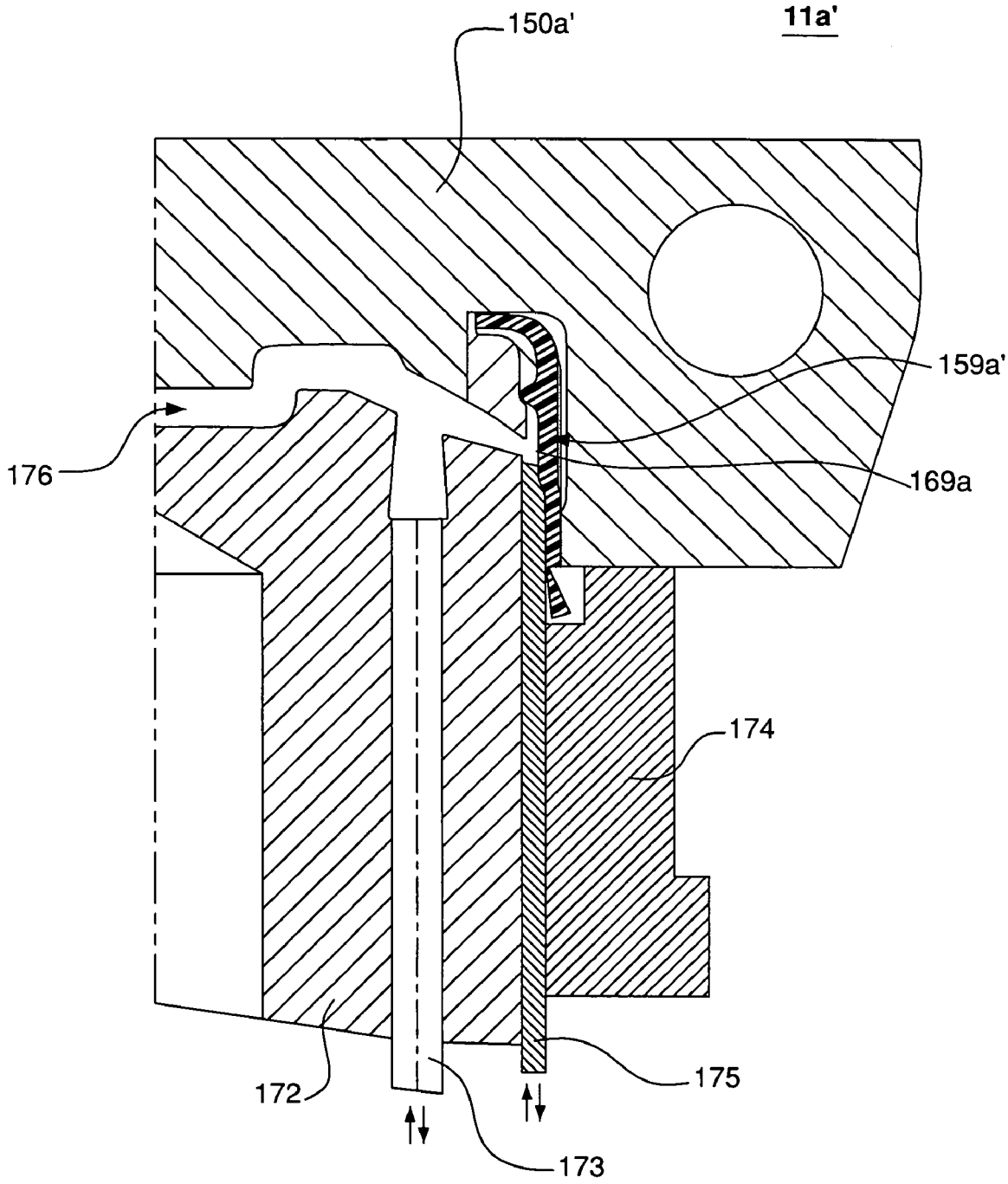
FIG. 10 is a sectional view of a second portion of the molding system of FIG. 8 according to an aspect of the present invention.

According to another aspect of the present invention, deformable element 26 may be injection molded in a second stage or step of the injection molding process, subsequent to the injection of material into cavity 159*a* to produce portion 159*a'*. As shown in FIG. 10, a system 11*a* is provided for performing molding subsequent to the molding discussed above with respect to system 11*a*. The closure portion 159*a'* may be transferred from the stage shown in FIG. 9 to the stage shown in FIG. 10 by robotic or automatic means, or, alternatively, the mold elements may be automatically moved so as to form the cavity 169*a*. Methods and systems for such transferring will be understood by persons familiar with such molding and actuation technology.

System 11*a*'includes a cavity block 150*a*' (the reference numeral includes a prime designation to indicate that the cavity block is in position for the subsequent molding step relating to deformable element 26), an inner core 172, a runner ejector 173, a core bushing 174, and a sleeve ejector 175. The runner system includes runner channel 176. The closure portion 159*a*' from the injection molding step described above is disposed within system 11*a*'. A deformable element cavity 169*a* is formed by a portion of skirt interior surface 28, which is formed on closure portion 159*a*', and surfaces of retaining member 8, inner core 172, and a portion of ejector sleeve 175.

Figure 11:
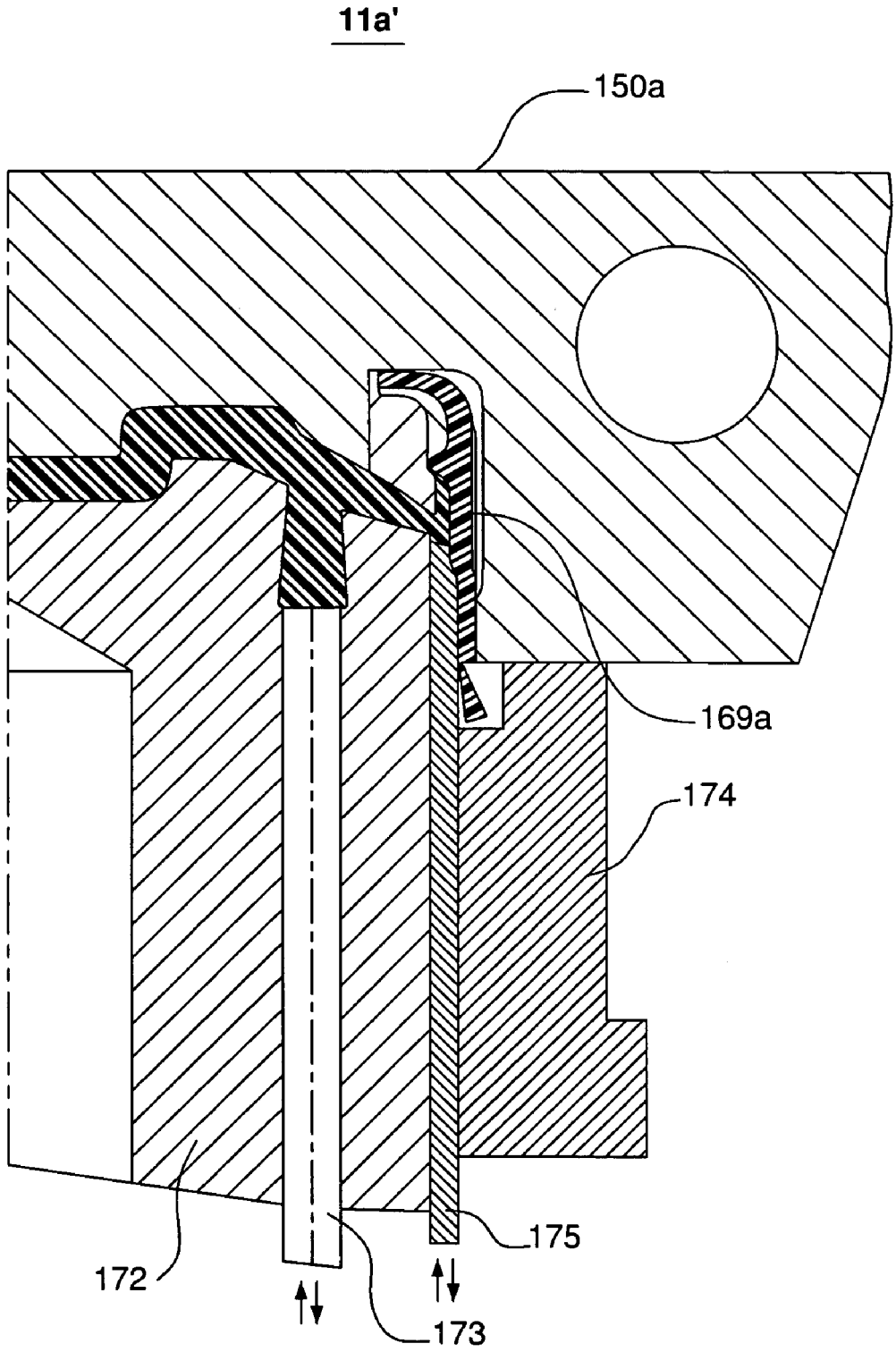
FIG. 11 is a sectional view of the portion of the molding system shown in FIG. 10 illustrating the deformable element formed therein.

To fill cavity 169*a*, material, such as the preferred TPE material described herein, is injected through channel 176 and into cavity 169*a*. FIG. 11 illustrates cavity 169*a* in its filled state. The cross-hatching indicates the material of deformable element 26, as described herein. Upon the completion of injection of such material into cavity 169*a*, and after separation of the runner and removal of the injection molded object from the mold 150*a*', closure 10*c* may be ready for installing onto container 12 as described above.

The present invention is not limited to the particular configuration of the molding elements described herein, but rather encompasses any configuration that is capable of forming suitable cavities therein. Further, any runner systems may be employed, including commercially available cold runners or hot runners.

Figure 12:
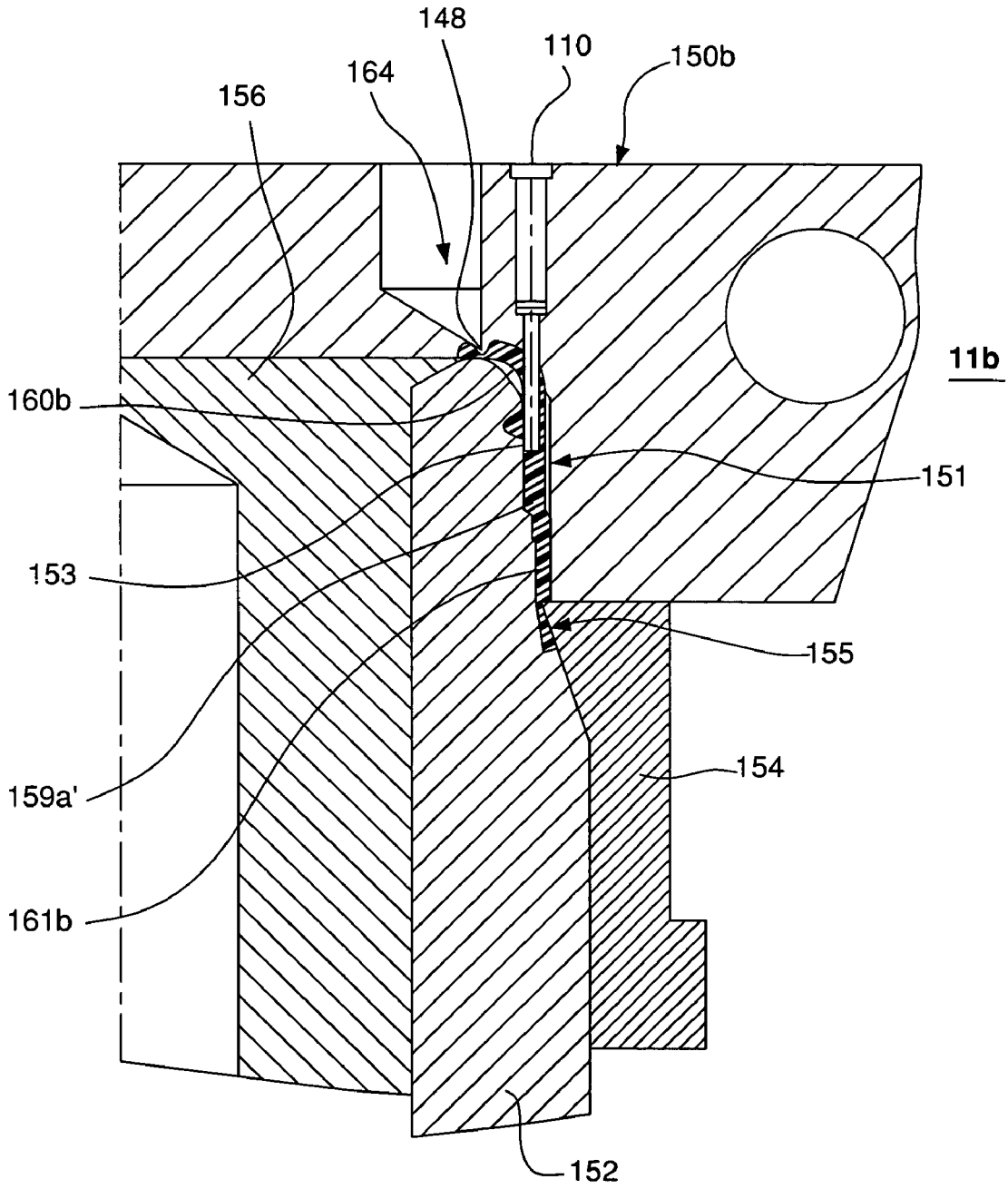
FIG. 12 is a sectional view of a first portion of another molding system according to another aspect of the present invention.

According to yet another aspect of the present invention, as illustrated in FIG. 12, a molding system 11*b* includes a molding cavity block 150*b*, a molding core 152, a stripper 154, an ejector 156, and a pin 110. Cavity block 150*b* defines a sprue 164 therethrough, as partially shown in FIG. 12. Cavity 150*b* defines a cavity block surface 151, core 152 defines a mold surface 153, and stripper 154 defines a surface 155 such that surfaces 151, 153, and 155 define a cavity 159*b*. Cavity 159*b* includes a cavityflange portion 160*b* and a cavity skirt portion 161*b*. Core surface 153 in the cavity skirt portion 161*b* corresponds (that is, in this case provides a surface for forming) skirt interior surface 28.

Pin 110 extends through cavity surface 151 and into cavity 159*b*. Preferably, pin 110 is in contact with mold surface 153 at cavity skirt portion 161*b*, and specifically in the region thereof in which annular member 26 is to be formed FIG. 12 illustrates system 11*b* with cavity 159*b* already in its injected molded state, such that a portion 159*b*' of the closure is shown. The present invention contemplates other configurations, such as for example a pin or pins extending through cavity 159*b* and through mold surface 153 into core 152. Pin 110 may be of any configuration, such as for example any cross section or shape, disposed through any part of the closure in any configuration, and the like variations.

To fill cavity 159*b*, a material, such as a the thermoplastic material described herein, is injected into sprue 164 and gate 48 into cavity 159*b*. Because pin 110 extends into or through cavity 159*b*, the removal of pin 110 subsequent to the injection molding forms passage 7 within the injection molded material 159'. Because the end of pin 110 is in contact with the core surface 153 during the injection stage, passage 7 is formed from the exterior surface of the closure portion 159*b*' to the interior portion of closure portion 159*b*' such that passage 7 enables the second material to flow from block 150*a* through closure portion 159*b*' to inner surface 28 thereof. Thus, passage 7 extends through a portion of the formed flange 23 and skirt 24, through which a second thermoplastic material may be injected to form the deformable element 26. FIG. 5 also shows passage 7.

Figure 13:
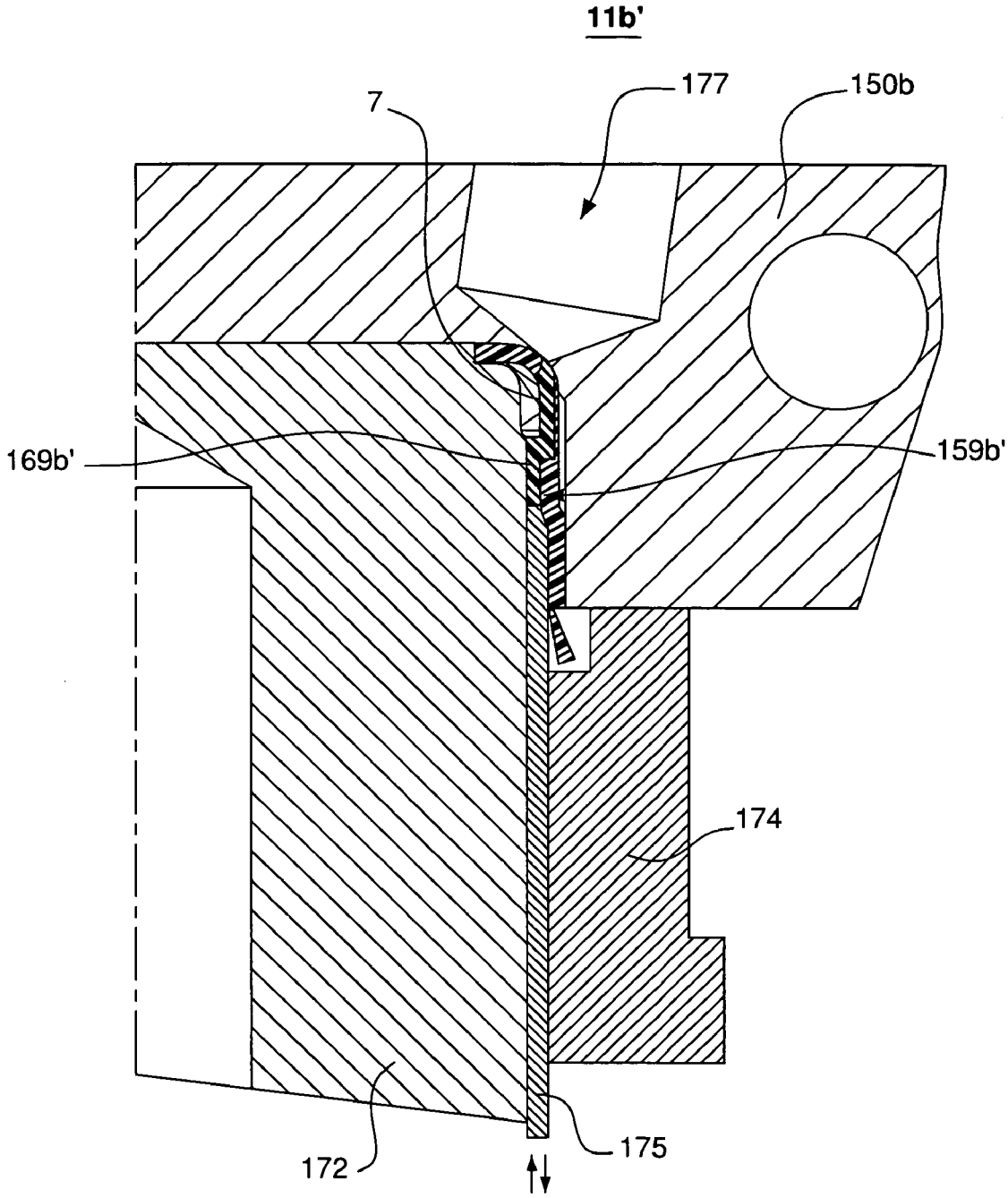
FIG. 13 is a sectional view of a second portion of the molding system of FIG. 12 according to an aspect of the present invention.

According to another aspect of the present invention, deformable element 26 may be injection molded in the second stage or step of the injection molding process, by employing a passage, such as passage 7, through a closure portion, such as portion 159*b*'. As shown in FIG. 13, a system 11*b*' is provided for performing molding subsequent to the molding discussed above with respect to system 11*b* and closure portion 159*b*'. System 11*b*' includes a cavity 150*b*' (which includes a prime designation to indicate that it is in position for the subsequent molding step relating to deformable element 26), an inner core 172, a core bushing 174, and a sleeve ejector 175 so as to enable the subsequent injection stage. A sprue 177 is formed in cavity 150*b*'. A deformable element cavity 169*b* is formed by a portion of the formed skirt interior surface 28, which is formed on closure portion 159', and a surface of retaining member 8, inner core 172, and a portion of ejector sleeve 175. FIG. 13 shows cavity 169*b* in its filled state so as to illustrate portion 169*b.'*

To fill cavity 169*b*, material, such as the preferred material described herein, is injected through sprue 177 and into cavity 169*b*. Sprue 177 may be positioned at or near an end of passage 7 (which is shown in FIG. 13 already having injection molded material disposed therein). Material may be injection molded through sprue 177, through passage 7, and into a cavity 169*b*, thereby forming deformable element 26.

The terms "first" and "second" are employed to refer to the equipment, such as the molds, and the processing steps for convenience. The denoted sequence, however, refers to a preferred sequence. The present invention, however, is not limited to the order denoted by the numeric sequence, but rather encompasses any order of the steps, as will be clear to persons familiar to the technology relating to the process steps and equipment to which the numeric sequence refers.

The scope of the present invention should not be construed as limited to the detailed description of the embodiments described herein. Rather, the present invention encompasses numerous variations on the configurations and steps disclosed herein, as will be understood by persons familiar with the relevant prior art in light of the present disclosure. Such modifications should be considered within the spirit and scope of the appended claims.

TABLE 1

| Type | Material | Supplier | Grade | Density | Tensile Modulus | Flexural Modulus | Hardness Shore A | Hardness Shore D |
|---|---|---|---|---|---|---|---|---|
| TPE | Soft PP | Montell | Adflex 7149 XEP | 0.89 | | 500 | | |
| TPE | SEBS | Evode | Evoprene 977 | 1.12 | | | 88 | 37 |
| TPE | PP/EPDM | AES | Santoprene | 0.97 | | 103 | 87 | |

TABLE 1-continued

| Type | Material | Supplier | Grade | Density | Tensile Modulus | Flexural Modulus | Hardness Shore A | Hardness Shore D |
|---|---|---|---|---|---|---|---|---|
| | | | 271/87 | | | | | |
| PP | PP Block Copolymer | Amoco | 510 GA 20 | 0.9 | | 900 | | |
| PP | PP Random Copolymer | BASF | Novolen 3300MC | 0.9 | 700 | | | |
| Blend | PE/PA6 Blend | Elf Atochem | Orgalloy LE60LM | 1.01 | | 750 | | 65 |
| PP | PP Homopolymer | Rexene | Rexflex W109 | | 380 | | | 63 |
| Blend (50/50) | Soft PP/PP Block Copolymer (see above) | Montell/ Amoco | Adflex/ 510 GA 20 | 0.9 | | 700 | | |
| TPE | Butyl Rubber | AES | Trefsin (3271-65w) | 0.97 | | 36 | 69 | |

What is claimed is:

1. A composite closure for mating with a container having a finish that includes threads formed thereon, the closure comprising:

a flange;

a skirt depending downwardly from a periphery of the flange and including a protrusion extending from an interior surface of the skirt, the skirt comprising a first material;

an insert disk disposed within the skirt and substantially beneath the flange; and a molded deformable element disposed on the interior surface of the skirt below the protrusion, the deformable element being spaced apart from the insert disk such that the insert disk is floatable, the deformable element comprising a second material and being deformable by the container threads to impress closure threads into the deformable element, the skirt protrusion is configured to restrict axial deformation of the deformable element towards the flange upon mating the closure with the container.

2. The closure of claim 1, wherein the flange and the skirt are integrally formed of the first material, the first material comprising a thermoplastic.

3. The closure of claim 2, wherein the thermoplastic comprises a polyolefin.

4. The closure of claim 1, wherein the deformable element is formed of the second material, the second material comprising a thermoplastic elastomer.

5. The closure of claim 1, wherein the flange, the skirt and the deformable element are injection molded.

6. The closure of claim 1, wherein at least one of the skirt and the deformable element is compression molded.

7. The closure of claim 1, wherein at least one of the skirt and the deformable element is formed by transfer molding.

8. The closure of claim 5, wherein the skirt and the deformable element are formed by injection molding sequentially in a single mold.

9. The closure of claim 1, wherein the skirt defines a passage therein from a second material injection point to a cavity that defines the deformable element such that a second material may be injected through the passage.

10. The closure of claim 1, wherein the flange comprises an opening, the insert disk being floatably disposed between an interior surface of the flange and a retaining member extending from the interior surface of the skirt.

11. The closure of claim 1, wherein said protrusion is annular.

12. The closure of claim 1, further comprising a tamper evident band frangibly coupled to a lower rim of the skirt.

13. A closure for mating with a container having a finish that includes a thread thereon, the closure comprising a body and a deformable element, the body comprising:

a flange;

a skirt depending downwardly from a periphery of the flange; and at least one passage extending from an exterior surface of the body to an interior surface of the body and at least partly through the skirt;

the deformable element being disposed on an interior surface of the skirt, the deformable element having at least one branch disposed within the at least one passage, whereby the deformable element is formed by injecting material through the at least one passage.

14. The closure of claim 13, wherein the deformable element is deformable by the container thread to impress a closure thread into the deformable element.

15. The closure of claim 13, wherein the flange and the skirt are formed of a material comprising a thermoplastic.

16. The closure of claim 13, wherein the deformable element is formed of a material comprising a thermoplastic elastomer.

17. The closure of claim 13, wherein the flange comprises an opening, and the closure further comprises an insert for covering the opening, the insert being floatably disposed between an interior surface of the flange and a retaining member extending from the interior surface of the skirt.

18. The closure of claim 13, further comprising protrusion extending from the skirt interior surface above the deformable element to restrict deformable element movement axially towards the flange.

19. The closure of claim 13, further comprising a tamper evident band frangibly coupled to a lower rim of the skirt.

20. A method for closing a package, comprising the steps of:

providing a container having a finish with threads disposed thereon, the threads having an outer diameter;

providing a closure comprising a flange, skirt depending downwardly from a periphery of the flange and including a protrusion extending from an interior surface of the skirt, and a deformable element disposed on an the interior surface of the skirt below the protrusion and spaced apart from the flange, the deformable element having an inner diameter that is smaller than the outer diameter of the finish threads, the skirt comprising a first material and the deformable element comprising a second material; and urging the closure onto the container finish such that the deformable element is deformed by the container thread to impress closure threads in the deformable element, such that the skirt protrusion restricts deformable element movement axially towards the flange during the urging step, and such that the deformable element remains spaced apart from the flange.

21. The method of claim 20, wherein the urging step comprises pressing the closure onto the container finish.

22. The method of claim 20, wherein the urging step comprises twisting the closure onto the container finish.

23. The method of claim 20, wherein the deformable element is formed of a material comprising a thermoplastic elastomer.

24. The composite closure of claim 1 wherein the second material is more malleable than the first material.

25. The composite closure of claim 1 wherein the second material has a different hardness than the first material.

26. The composite closure of claim 1 wherein the second material has a different compression set value than the first material.

27. The composite closure of claim 1 wherein the deformable element is circumferentially continuous.

28. The composite closure of claim 1 wherein the deformable element comprises, in transverse view, plural circular segments separated by narrow gaps.

29. The composite closure of claim 13 wherein the deformable element is more malleable than the skirt.

30. The composite closure of claim 13 wherein the deformable element has a different hardness than the skirt.

31. The composite closure of claim 13 wherein the deformable element has a different compression set value than the skirt.

32. The composite closure of claim 13 wherein the deformable element is circumferentially continuous.

33. The composite closure of claim 13 wherein the deformable element comprises, in transverse view, plural circular segments separated by narrow gaps.

34. The composite closure of claim 20 wherein the second material is more malleable than the first material.

35. The method of claim 20 wherein the second material has a different hardness than the first material.

36. The method of claim 20 wherein the second material has a different compression set value than the first material.

37. The method of claim 20 wherein the deformable element is circumferentially continuous.

38. The method of claim 20 wherein the deformable element comprises, in transverse view, plural circular segments separated by narrow gaps.

39. The method of claim 20 wherein the protrusion is annular.

* * * * *